US005301718A

United States Patent [19]

Bolhofner

[11] Patent Number: 5,301,718

[45] Date of Patent: Apr. 12, 1994

[54] APPARATUS AND PROCESS FOR METERING A LOW PRESSURE FLUID INTO A HIGH PRESSURE FLUID FLOW

[75] Inventor: Kenneth R. Bolhofner, Fairview Heights, Ill.

[73] Assignee: Chemstar, Inc., St. Louis, Mo.

[21] Appl. No.: 20,765

[22] Filed: Feb. 22, 1993

Related U.S. Application Data

[63] Continuation-in-part of Ser. No. 805,194, Dec. 9, 1991, abandoned.

[51] Int. Cl.[5] ..... B01F 5/04

[52] U.S. Cl. ..... 137/893; 137/895; 137/526

[58] Field of Search ..... 137/893, 895, 526, 888, 137/100

[56] References Cited

U.S. PATENT DOCUMENTS

| | | | |
|---|---|---|---|
| 4,186,772 | 2/1980 | Handleman | 137/893 X |
| 4,722,363 | 2/1988 | Allyn | 137/888 X |
| 4,955,507 | 9/1990 | Kirschner | 137/100 |
| 5,218,988 | 6/1993 | McNamara | 137/895 X |

FOREIGN PATENT DOCUMENTS

| | | | |
|---|---|---|---|
| 837336 | 7/1949 | Fed. Rep. of Germany | 137/895 |

*Primary Examiner*—Robert G. Nilson
*Attorney, Agent, or Firm*—Rogers, Howell & Haferkamp

[57] ABSTRACT

An apparatus for metering an accurate flow of a first fluid, at a low pressure and a low flow rate, into a conduit conducting a flow of a second fluid, at a much higher pressure and much greater flow rate, comprises a pressure reducer containing a nozzle and a peristaltic pump connected in fluid communication with the pressure reducer. The pressure reducer is connected in the conduit and the nozzle of the pressure reducer increases the flow rate of the second fluid flowing through the pressure reducer, thereby correspondingly reducing the pressure of the second fluid in the pressure reducer. The peristaltic pump supplies the first fluid to an area of the bore through the pressure reducer where the nozzle has decreased the pressure of the second fluid channeled through the pressure reducer. A pressure relief valve communicates with the pressure reducer to prevent the pressure of the second fluid from decreasing below a third fluid pressure.

14 Claims, 1 Drawing Sheet

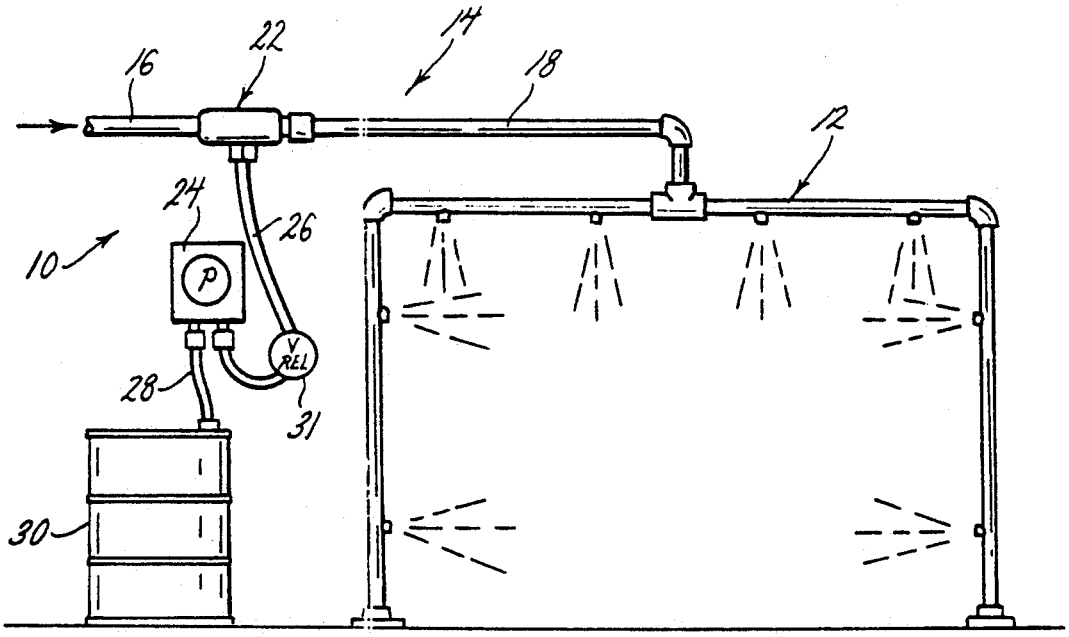
FIG. 1.
FIG. 2.
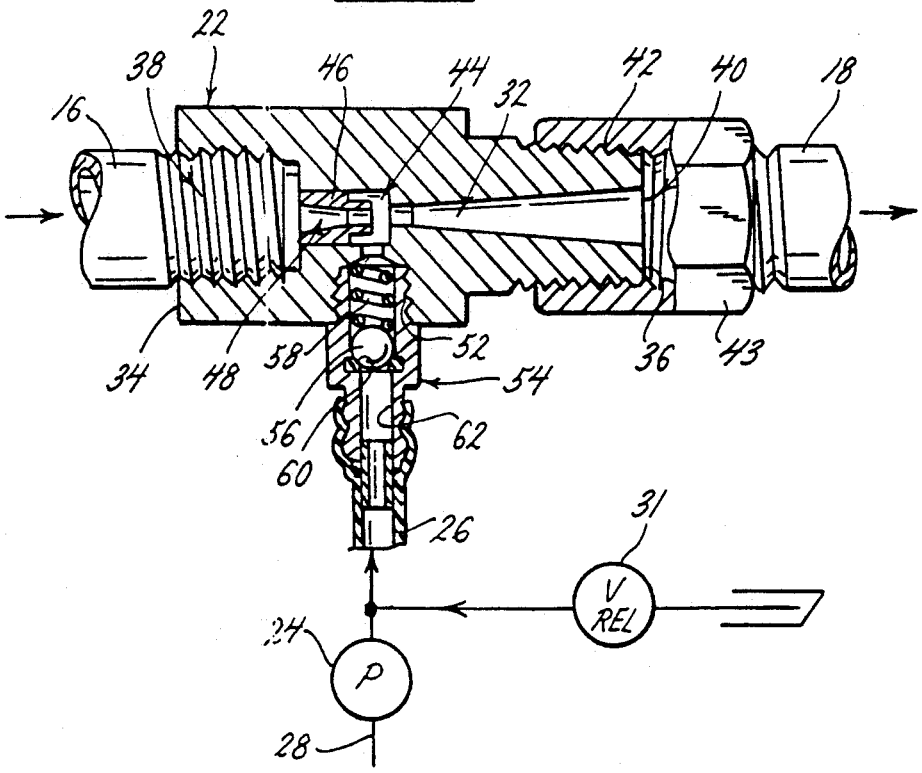

APPARATUS AND PROCESS FOR METERING A LOW PRESSURE FLUID INTO A HIGH PRESSURE FLUID FLOW

This application is a continuation-in-part of U.S. patent application Ser. No. 07/805,194, filed Dec. 9, 1991 and now abandoned.

BACKGROUND OF THE INVENTION (1) Field of the Invention

The present invention relates to an apparatus and method of metering a low pressure fluid into a high pressure fluid flow. The fluids include gases, liquids, flowable solids, slurries, etc. In particular, the present invention relates to a fluid dispensing system that employs a peristaltic pump to dispense an accurate, continuous flow of a first fluid at a first pressure into a fluid conduit conducting a second fluid at a second pressure greater than the pressure of the first fluid. A pressure reducer assembly is inserted in the fluid conduit to reduce the pressure of the second fluid to a pressure below the pressure of the first fluid by increasing the flow velocity of the second fluid, thereby enabling the peristaltic pump to pump the first fluid at the first pressure into the fluid conduit. A pressure relief valve is provided in the feed line between the peristaltic pump and the pressure reducer to prevent the creation of a vacuum pressure in the feed line which could interfere with the proper operation of the pump.

(2) Description of the Related Art

In fluid mixing systems of the prior art, it is often necessary to mix a first fluid with a second fluid being carried by a fluid conduit, where only a very small amount of the first fluid is desired to be combined with a much greater amount of the second fluid. For example, it is often necessary to feed very small amounts of a first fluid, in the order of $5.0\times10^{-4}$ gallons per minute, at an accurate and continuous rate of feed into a conduit conducting a second fluid at a much greater pressure than the first fluid. It is also necessary to provide such a fluid mixing system that is inexpensive to construct and operate, and will operate reliably for a period of five to ten years.

Previous efforts in the prior art to provide such a fluid mixing system have employed small diaphragm or piston pumps, suction devices such as orifices, and mechanical syringe fluid dispensers. However, these prior art systems are typically incapable of providing the desired continuous and accurately metered flow rate of the first fluid into the conduit conducting the second fluid.

Peristaltic pumps or tube pumps are capable of delivering a continuous and accurately metered low flow rate of fluid. However, peristaltic pumps are typically limited to low pressure head applications (20 psig to 70 psig maximum). When connecting a first fluid line carrying fluid pumped at a low flow rate and low pressure by a peristaltic pump, to a second fluid line conducting a second fluid at a much higher pressure, the high pressure of the second fluid carried in the second line will in most cases cause the first fluid pumped by the peristaltic pump in the first fluid line to back up and increase in pressure until the pressure of the first fluid prevents the peristaltic pump from working properly. The increase in pressure of the first fluid could possibly reach a level that prevents the peristaltic pump from rotating and the increase in the pressure level could burst an output hose or conduit of the pump, or the pump tube itself. The increase in pressure could also cause the fluid to be backed up through the pump or cause the pump to run backward and damage the pump motor.

What is needed to overcome these disadvantages of prior art fluid mixing systems is an apparatus and method of dispensing a continuous, accurately metered flow of a first fluid at a low pressure, into a flow of a second fluid conducted by a fluid conduit where the second fluid has a much higher pressure. Such a fluid mixing system must be inexpensive to construct and operate, and must operate reliably over a period of five to ten years to be practical.

SUMMARY OF THE INVENTION

The apparatus and process for metering a low pressure fluid into a high pressure fluid flow of the present invention provides a system of mixing a continuous, accurately metered flow of a first fluid with a second fluid having a much greater pressure than the first fluid. The fluids may be gases, liquids, flowable solids, slurries, etc. The apparatus of the invention is generally comprised of a venturi pressure reducer assembly, a peristaltic pump, a first length of hose or fluid conducting conduit connecting the output of the peristaltic pump to the pressure reducer assembly, a pressure relief valve connected to the first length of conduit, and a second length of hose or fluid conducting conduit connecting the input of the peristaltic pump with a source of a first fluid desired to be added to a flow of a second fluid conducted by a conduit at a high pressure and high flow rate.

The venturi pressure reducer assembly is connected in fluid communication with the conduit conducting the flow of the second fluid between an upstream side and a downstream side of the conduit. The pressure reducer assembly has a bore extending through the assembly that channels the flow of second fluid from the upstream side of the conduit, through the bore, to the downstream side of the conduit. A nozzle is provided in the bore and the flow of second fluid passes through the nozzle. The nozzle increases the flow velocity of the second fluid, and thereby decreases the pressure of the second fluid as it passes through the bore. The pressure reducer assembly is also provided with a fluid inlet that communicates with the bore in an area of the bore where the flow of second fluid, having increased flow velocity and decreased pressure, exits the nozzle.

The outlet of the peristaltic pump is connected in fluid communication with the inlet of the pressure reducer by the first length of hose. The pressure relief valve is connected to the first length of hose between the pump and pressure reducer and vents the hose to the atmosphere should the reducer create a vacuum pressure in the hose. The connection of the first length of hose between the peristaltic pump and the pressure reducer inlet communicates the output of the peristaltic pump with the pressure reducer internal bore in the area of the bore where the flow of second fluid, having increased flow velocity and decreased pressure, exits the nozzle. The input of the peristaltic pump is connected in fluid communication with the first fluid source by the second length of hose or fluid conduit. This arrangement enables the peristaltic pump to pump a continuous, accurately metered flow of first fluid at a low flow rate and low pressure into the flow of second fluid conducted by the fluid conduit. Although the pressure of the flow of second fluid conducted by the conduit is much greater than the pressure of the first fluid metered by the peristaltic pump, the nozzle of the venturi pressure reducer assembly connected in fluid communication with the fluid conduit reduces the pressure of the flow of second fluid in the area of the bore where the peristaltic pump is supplying the metered flow of first fluid. By reducing the pressure of the second flow of fluid in this area, the apparatus of the invention is capable of supplying a metered flow of first fluid at a first pressure to a flow of second fluid at a second pressure, much greater than the first pressure, without the pressure of the second fluid increasing the pressure of the first fluid and preventing the peristaltic pump from working properly.

BRIEF DESCRIPTION OF THE DRAWINGS

Further objects and features of the present invention are revealed in the following detailed description of the preferred embodiment of the invention and in the drawing figures wherein:

FIG. 1 is an elevation view of the apparatus of the invention employed in the operative environment of a car wash sprayer arch fluid dispensing system; and FIG. 2 is an elevation view, partially in section, showing the details of the pressure reducer assembly of the present invention.

DESCRIPTION OF THE PREFERRED EMBODIMENT

FIG. 1 shows the apparatus for metering a low pressure fluid into a high pressure fluid flow of the present invention in one operative environment of the invention. In FIG. 1, the apparatus of the invention is shown employed in a chemical dispensing system of a car wash. The car wash chemicals may include soap, wax, presoak, rinse aids, etc. It should be understood that this operative environment of the invention shown is illustrative only and is not intended to be limiting. The low pressure fluid metering apparatus of the invention may be employed in a variety of situations where it is desired to continuously meter a first fluid at a low flow rate and a low pressure, into a flow of a second fluid having a much higher pressure. The fluids may be gases, liquids, flowable solids, slurries, etc.

In the operative environment of FIG. 1, the apparatus of the invention 10 is employed in a fluid conduit system comprising a car wash spraying arch 12 dispensing a spray of car wash chemicals and water, and a feed conduit 14 supplying the chemicals and water to the arch. The spray arch 12 is conventional and does not form a part of the present invention. The feed conduit 14 is comprised of an upstream side 16 conducting water at a high pressure and high flow rate, and a downstream side 18 conducting a combination of the water at high pressure and high flow rate and the car wash chemicals added to the water.

The apparatus of the invention 10 is connected in fluid communication with the feed conduit 14 between the upstream side 16 and the downstream side 18. The apparatus of the invention is basically comprised of a venturi pressure reducer assembly 22, a peristaltic pump 24, first and second lengths of hose 26, 28 communicating the pump 24 with the pressure reducer 22 and a supply of the car wash chemicals contained in a drum 30, and a pressure relief valve 31 connected to the first length of hose 26.

The detail of the venturi pressure reducer assembly 22 of the apparatus of the invention is shown in FIG. 2. The pressure reducer assembly 22 shown and described is only one of many different types of pressure reducers that may be employed as part of the invention. For example, a length of pipe having a smaller cross-section diameter than the feed conduit 14 may be employed as the pressure reducer. Other methods of increasing the flow velocity of the second fluid, and thereby decreasing the pressure of the second fluid, may be employed in the invention without departing from the intended scope of the invention. The reducer assembly 22 has a general tubular configuration with an internal bore 32 extending completely through the reducer assembly from an input side 34 of the assembly to an output side 36 of the assembly. As seen in FIG. 2, the bore 32 is configured with an input end 38 having internal screw threads for mating with complementary external screw threads on the upstream side 16 of the fluid feed conduit 14. An output end 40 of the bore is tapered and diverges as it approaches the output side 36 of the reducer assembly where it communicates with the downstream side 18 of the fluid feed conduit 14. The pressure reducer assembly 22 is provided with external screw threads 42 adjacent its output side 36 enabling the reducer assembly to be connected to a complementary threaded coupler 43 on the downstream side 18 of the fluid feed conduit.

An annular chamber 44 is provided in the internal bore 32 of the reducer assembly intermediate the input end 38 and the output end 40 of the bore. A nozzle 46 is secured inside the annular chamber 44. The nozzle 46 also has an internal bore 48 that tapers and converges in the direction of fluid flow through the reducer assembly 22, or from left to right as shown in FIG. 2. The nozzle internal bore 48 provides an area in the bore 32 of the pressure reducer having a cross-section diameter that is smaller than the cross-section diameter of the feed conduit 14. As seen in FIG. 2, the nozzle 46 is positioned to the left in the annular chamber 44, leaving an area in the chamber adjacent the exit of the nozzle for fluid mixing.

A fluid inlet 52 is provided in one side of the reducer assembly 22. The inlet 52 intersects the annular chamber 44 at the area of the chamber adjacent the exit of the nozzle 46.

A one way check valve assembly 54 is secured in the fluid inlet 52. The check valve assembly 54 is conventional and includes a ball valve element 56 biased by a coiled spring 58 against a valve seat orifice 60. The check valve 54 controls the direction of fluid flow through the internal bore 62 of the valve. As viewed in FIG. 2, the check valve 54 enables fluid flow in an upward direction through the internal bore 62 of the valve to the annular chamber 44 of the reducer assembly 22, and prevents the flow of fluid downward through the internal bore 62 of the valve from the annular chamber 44. The one way check valve assembly 54 is connected in fluid communication with the first length of hose 26 that is connected in fluid communication with the fluid output of the peristaltic pump 24.

The peristaltic pump 24 of the apparatus of the invention is of conventional construction and the component parts of the pump are not shown in detail. In the preferred embodiment of the invention, a fluid inlet of the pump 24 is connected in fluid communication with the drum of chemicals 30 by the second length of hose 28. The peristaltic pump 24 draws the chemicals from the drum 30 and pumps the chemicals through the first length of hose 26 at a very low flow rate. Peristaltic pumps are capable of pumping outputs that range from $3.0\times10^{-4}$ gallons per minute to 50 gallons per minute or more, and at a pressure in the pressure range of 20–70 psig. The particular flow rate can vary through a wide range depending on the particular environment in which the apparatus of the invention is used. Other peristaltic pumps capable of pumping fluid at different flow rates and different pressures may be employed in other applications of the invention without departing from the intended scope of the invention. As is typical of peristaltic pumps, the peristaltic pump 24 is capable of pumping a very accurately metered continuous flow of the chemical from the source of the concentrate 30 through the first length of hose 26 and into the pressure reducer assembly 22.

The pressure relief valve 31 is positioned in the first hose 26 and vents the hose to the atmosphere should the pressure reducer 22 create a vacuum pressure in the hose. The construction of the valve 31 is conventional and it is shown only schematically in the drawing figures. Preferably, the valve 31 vents the hose 26 to atmosphere should any vacuum pressure build up in the hose. Alternatively, the valve 31 could be adjusted, as is conventional, to vent to atmosphere should a predetermined level of vacuum pressure build up in the first hose depending on the application of the invention.

The pressure reducer assembly 22 of the apparatus of the invention is interposed in the fluid feed conduit 14 supplying water at a high flow rate and high pressure to the spray arch 12, to enable the addition of metered amounts of the chemicals at a very low flow rate and low pressure to the conduit 14. In the preferred embodiment of the invention the pressure of the water is greater than 20 psi. The flow rate of the water through the conduit 18 is dependent on the cross-sectional area of the conduit in the particular application, but in most applications it will be much greater than the flow rate of the first fluid pumped by the peristaltic pump. In operation of the apparatus with the pressure reducer assembly 22 connected between an upstream side 16 and a downstream side 18 of the fluid feed conduit 14, and with water flowing through the pressure reducer 22 from left to right as shown in the drawing figures, the internal bore 32 channels the flow of water received from the upstream side 16 of the conduit, through the pressure reducer assembly 22, and supplies the flow of water to the downstream side of the conduit 18.

As the flow of water is channeled through the bore 32 of the pressure reducer, it passes through the constriction of the nozzle 46. As the cross sectional area of the pressure reducer bore is reduced to its minimum at the exit at the right most end of the nozzle 46, the flow velocity of the water channeled through the internal bore 32 is increased. This follows from fundamental volumetric flow rate principles of fluid mechanics which require that the volumetric flow rate of fluid entering the nozzle bore 48 must equal the volumetric flow rate of fluid exiting the nozzle bore. This principle of continuity is expressed by the equation: $Q=AV$ (entrance)$=AV$ (exit). The volumetric flow rate (Q) at the entrance and exit of the bore are both determined by multiplying the cross sectional area (A) of the nozzle bore at the entrance and exit respectively, by the velocity of fluid flow (V) through the nozzle bore at the entrance and exit. These two products must be equal. As the cross sectional area of the nozzle bore decreases as it approaches the nozzle exit, the velocity of fluid flow through the nozzle bore must correspondingly increase to its maximum velocity exiting the nozzle bore.

By applying fundamental fluid mechanics and in particular Bernoulli's equation to the situation occurring at the exit of the nozzle 46, the increase in the velocity of the fluid exiting the nozzle into the annular chamber 44 requires that the pressure of the fluid in the annular chamber must decrease. Bernoulli's equation states that for steady, nonviscous, incompressible flow: $\frac{1}{2}\rho v^2+p=\text{constant}$; and where the density of the fluid ($\rho$) is constant and the velocity (v) of the fluid flow increases, the pressure (p) must decrease.

In the present invention, the cross sectional areas at the entrance and exit of the nozzle bore 48 are chosen in conformance with the existing pressure and flow rate of the water passing through the fluid feed conduit 14 to produce a reduced pressure of the water in the annular chamber 44 that is at or below the pressure of the chemicals being supplied by the peristaltic pump 24 to the annular chamber. In this manner, the apparatus of the invention enables the first fluid of the chemicals to be supplied at a slow and accurate flow rate and a low pressure to the mixing chamber 44 of the pressure reducer 22 where the first fluid chemicals are added to a second fluid or water being conducted at a high flow rate and high pressure through the fluid feed conduit 14. The chemicals are mixed with the water in the annular chamber 44 and are then conducted through the output end of the pressure reducer bore 40 and the downstream side of the conduit 18 to the spray arch 12 of the car wash.

The pressure relief valve 31 is provided in the first length of hose 26 to prevent the pressure reducer 22 from creating a vacuum pressure in the hose that could cause dissolved gases in the first fluid to be drawn out of the fluid and expanded into a gas phase. Expansion of the dissolved gases in the fluid into their gas phase could produce up to a 90 percent void in the first hose causing inconsistent and/or interruptions in the metered flow of the first fluid supplied by the pump 24 to the pressure reducer 22. In the preferred embodiment the relief valve 31 vents the first hose 26 to atmosphere whenever a vacuum pressure is created in the hose and thereby prevents the expansion of the dissolved gases of the low pressure fluid as it is pumped to the reducer 22.

In the operative environment in which the apparatus of the invention 10 is described as being employed above, prior art chemical mixing systems typically mix a chemical, or first fluid, with the flow of water carried by the feed conduit in proportions where a large supply of the chemicals are needed for operating the car wash over a period of time. Conventional car wash chemicals are provided in a 55 gallon drum and are usually used up in a month of car wash operations.

In contrast to this, because the apparatus of the invention is capable of supplying a continuous, accurately metered flow of the first fluid at a very low flow rate to the flow of water conducted through the fluid conduit at a high flow rate and high pressure, the apparatus may be employed to mix an ultraconcentrate of the car wash chemicals into the flow of water carried by the conduit. This enables the source of first fluid, the car wash chemicals, to be concentrated and stored in a container or drum much smaller than the usual 55 gallon drum for known car wash chemicals, while lasting as long or longer than the prior art 55 gallon drum of chemicals. By enabling chemical concentrates in smaller amounts to be used in the operations of a car wash, the present invention eliminates the need for large 55 gallon drums to transport and store the chemicals and thereby reduces the shipping and handling costs for the chemicals. The smaller amounts of chemical concentrate are less expensive to ship, and because they last longer, they don't have to be shipped as often.

Other advantages of the apparatus of the invention include its ability to be used to dispense an accurate flow of a variety of fluids including liquids, gases, slurries, abrasives, etc. Because a peristaltic pump is employed in the apparatus, the fluids dispensed by the pump never touch any of the moving parts of the pump and therefore strong corrosive materials may be pumped without causing damage to the pump. This enables the apparatus of the invention to be employed in dispensing a variety of different types of chemicals. With very few moving parts, the apparatus is very simple to understand and maintain.

Although the apparatus of the invention is disclosed as supplying a car wash chemical at an accurate, extremely low flow rate and low pressure to a flow of water conducted through a conduit at a relatively high flow rate and high pressure, the apparatus of the invention may be employed in other applications where it is desired to supply a first fluid at a low flow rate and low pressure to a second fluid being conducted through a conduit at a high pressure.

While the present invention has been described by reference to a specific embodiment, it should be understood that modifications and variations of the invention may be constructed without departing from the scope of the invention defined in the following claims.

What is claimed is:

1. An apparatus for metering a flow of a first fluid at a first pressure, into a conduit conducting a flow of a second fluid at a second pressure greater than the first pressure, the apparatus comprising:

means for being coupled into the conduit between an upstream side of the conduit and a downstream side of the conduit and for decreasing the pressure of the second fluid at the coupled means to a third pressure less than the first pressure;

means communicating with the coupled means for maintaining the pressure of the second fluid at the coupled means at the third pressure;

means for supplying a substantially constant metered flow of the first fluid to the coupled means at the first pressure, the coupled means receiving the flow of first fluid at the first pressure and adding the first fluid received to the second fluid at the coupled means with the pressure of the second fluid being reduced to the third pressure; and, the metered flow supplying means includes a peristaltic pump connected in fluid communication between a source of the first fluid and the coupled means, the peristaltic pump drawing first fluid from the source of first fluid and supplying the first fluid to the coupled means at the first pressure.

2. The apparatus of claim 1, wherein:

the coupled means includes a pressure reducer having a bore extending therethrough, the bore conducting the flow of second fluid through the pressure reducer between the upstream and downstream sides of the conduit and increasing the flow velocity of the second fluid in the bore and thereby decreasing the pressure of the second fluid in the bore to the third pressure, less than the first pressure.

3. The apparatus of claim 2, wherein:

the pressure reducer has an inlet that intersects the bore in an area of the bore where the pressure of the second fluid is decreased, and the peristaltic pump is connected in fluid communication with the inlet and supplies the first fluid at the first pressure to the area of the bore where the pressure of the second fluid is decreased.

4. The apparatus of claim 3, wherein:

the means for maintaining the pressure of the second fluid at the third pressure is a pressure relief valve connected in fluid communication between the inlet and the peristaltic pump, the pressure relief valve also preventing fluid pressure of a flow of the first fluid from the peristaltic pump to the inlet from decreasing below the third pressure.

5. The apparatus of claim 2, wherein:

a fluid conducting conduit extends between the peristaltic pump and the pressure reducer and provides fluid communication between the peristaltic pump and the pressure reducer, and the means for maintaining the pressure of the second fluid at the third pressure is a pressure relief valve connected in fluid communication with the fluid conducting conduit, the pressure relief valve preventing fluid pressure within the fluid conducting conduit from decreasing below the third pressure.

6. The apparatus of claim 5, wherein:

the third pressure is a vacuum pressure, and the pressure relief valve vents the fluid conducting conduit to atmosphere when the fluid pressure in the fluid conducting conduit decreases below the third pressure.

7. The apparatus of claim 5, wherein:

the third pressure is zero gauge pressure, and the pressure relief valve vents the fluid conducting conduit to atmosphere when the fluid pressure of the fluid conducting conduit is a vacuum pressure.

8. An apparatus for metering a flow of a first fluid at a first pressure, into a conduit conducting a flow of a second fluid at a second pressure greater than the first pressure, the apparatus comprising:

a pressure reducer adapted to be connected in the conduit between an upstream side of the conduit and a downstream side of the conduit, the pressure reducer having a bore extending therethrough to channel the second fluid through the pressure reducer from the upstream side of the conduit to the downstream side of the conduit, the bore being configured to increase the flow velocity of second fluid channeled through the bore and thereby reduce the pressure of the flow of second fluid through the bore to a third pressure less than the second pressure, and the pressure reducer having a fluid inlet intersecting the bore between the upstream side and the downstream side of the conduit;

a pressure relief valve connected in fluid communication with the fluid inlet of the pressure reducer, the pressure relief valve preventing the pressure of the second fluid at the intersection of the fluid inlet and the bore from being reduced below the third pressure; and a peristaltic pump connected in fluid communication between a source of the first fluid and the fluid inlet of the pressure reducer, the peristaltic pump drawing first fluid from the source of first fluid and pumping a metered flow of the first fluid at the first pressure to the inlet of the pressure reducer.

9. The apparatus of claim 8, wherein:

the bore is configured to increase the flow velocity of the second fluid channeled through the bore in a predetermined area of the bore, and the fluid inlet intersects the bore at the predetermined area.

10. The apparatus of claim 8, wherein:

the bore is configured to increase the flow velocity of the second fluid, and thereby decrease the pressure of the second fluid to a pressure less than the first pressure.

11. The apparatus of claim 10, wherein:

the pressure relief valve prevents the pressure of the second fluid from being decreased below the third pressure, and the third pressure is less than the first pressure.

12. The apparatus of claim 8, wherein:

a fluid conducting conduit extends between the peristaltic pump and the pressure reducer and provides fluid communication between the peristaltic pump and the pressure reducer, and the means for maintaining the pressure of the second fluid at the third pressure is a pressure relief valve connected in fluid communication with the fluid conducting conduit, the pressure relief valve preventing fluid pressure within the fluid conducting conduit from decreasing below the third pressure.

13. The apparatus of claim 12, wherein:

the third pressure is a vacuum pressure, and the pressure relief valve vents the fluid conducting conduit to atmosphere when the fluid pressure in the fluid conducting conduit decreases below the third pressure.

14. The apparatus of claim 9, wherein:

the bore is configured to decrease the pressure of the second fluid channeled through the bore in the predetermined area of the bore to a pressure less than the first pressure, and the peristaltic pump pumps the metered flow of first fluid at the first pressure through the inlet and adds the first fluid to the second fluid at the predetermined area of the bore.

* * * * *